US005688351A

United States Patent [19]

Thomas

[11] Patent Number: 5,688,351

[45] Date of Patent: Nov. 18, 1997

[54] MACHINE AND METHOD FOR FORMING LAMINATIONS

[76] Inventor: John S. Thomas, 2410 Everett Ave., Raleigh, N.C. 27607

[21] Appl. No.: 626,718

[22] Filed: Apr. 1, 1996

[51] Int. Cl.[6] ..... B27G 11/00

[52] U.S. Cl. ..... 156/214; 156/274.6; 144/349; 144/255

[58] Field of Search ..... 156/212, 214, 156/272.2, 274.4, 274.6, 486, 481, 489, 475, 582, 583.5, 583.1; 144/381, 255, 349

[56] References Cited

U.S. PATENT DOCUMENTS

| | | | |
|---|---|---|---|
| 1,766,963 | 6/1930 | Strupe | 144/255 |
| 1,982,447 | 11/1934 | Nash | 144/255 |
| 2,303,003 | 11/1942 | Rumsey | 156/214 |
| 2,386,821 | 10/1945 | Tardiff | 156/214 |
| 3,835,904 | 9/1974 | Sumner | 144/349 |

*Primary Examiner*—Jeff H. Aftergut
*Assistant Examiner*—Michael A. Tolin
*Attorney, Agent, or Firm*—Rhodes, Coats, & Bennett, LLP

[57] ABSTRACT

A machine and method for forming a variety of predetermined shapes of curved laminations formed from a plurality of individual laminates bonded together by an adhesive. The laminating machine comprises a support frame, a rotating RF-conducting capstan mounted in the support frame, and an RF-conducting anvil supported by the support frame in opposing relation to the capstan. An RF energy source is operatively connected to the capstan, and a ground terminal is operatively connected to the anvil. Custom template flanges serve both as determinants of a particular lamination's curved shape and also preferably as components of the completed laminated structure, which includes the curved lamination. Each template flange includes a laminate retainer, preferably an elongated groove, which holds a foundation laminate in a predetermined curved shape. Additional structural laminates are laminated onto facing surfaces of the foundation laminate so that the lamination thus formed assumes the predetermined shape of the foundation laminate. In operation of the laminating machine, the laminates are fed through a lamination passage between the capstan and the anvil, whereby the laminates are pressed together into a completed curved lamination. At the same time, RF energy is transmitted across the lamination passage from the capstan to the anvil to heat-cure adhesive applied to facing surfaces of the laminates.

30 Claims, 10 Drawing Sheets

MACHINE AND METHOD FOR FORMING LAMINATIONS

FIELD OF THE INVENTION

The present invention generally relates to machines and methods for forming laminations from a plurality of individual laminates and particular relates to a machine and method for continuously laminating curved wooden strips to form varying shapes and sizes of arched window and doorway headers and the like.

BACKGROUND OF THE INVENTION

Although wood is one of the most widely used building materials, wood presents challenges to carpenters and craftsmen in some applications such as arched window and doorway headers. Forming such curved structures from wood is often difficult because wood is relatively brittle compared to steel or other molded building materials. However, it is well known that thin strips of wood can much more easily be bent without breaking than can thick pieces of wood. Therefore, instead of building curved wooden structures from solid wood, builders often construct curved wooden structures using laminated wood comprised of a plurality of thin wooden strips joined together by a suitable adhesive. If a laminated structure is formed in a curved shape from the outset, the chance of breakage is minimized.

Several techniques have been developed over the years to bend wood laminations into particular shapes. One technique is to press laminations between mating convex and concave solid forms. Various means can be employed to hold both sides of the form together and thereby apply pressure to both sides of the laminations. For example, screws or clamps may be used to hold the forms together or air clamps or hydraulic presses may be substituted for particularly heavy-duty applications. The forms are usually made of wood or metal and must be accurately shaped to prevent pressure variations along their length.

In the alternative, a flexible metal band may be used in place of the concave side of the form. In this case, the wood laminations are pulled tightly down over the convex form by the metal band, which is attached at one or both ends to screws, a hydraulic press, or other device to pull it tight over the wood laminations.

Both of the above techniques suffer from several disadvantages, however. Most fundamentally, each complete form can only produce laminated wood products of one size and shape. A woodworking shop that produces a variety of curved laminated products will therefore require a multitude of forms, each one serving only a single purpose. In addition to taking up excessive space, stocking a multitude of forms is extremely cost-inefficient and does not allow for custom woodwork without the expense of creating a new form solely for a single project.

Another disadvantage, at least with the flexible metal band type of form, is that reverse curves in the laminations are difficult if not impossible to create. Reverse curves or "S-curves" are multidirectional curves in which a chord connecting one point of the curve to another point of the curve may pass both inside or outside of the curve, depending on what two points of the curve are connected. This is opposed to a unidirectional curve in which a chord connecting one point of the curve to another point of the curve always passes inside the curve. Forms used to create reverse curves are neither completely convex nor concave, but some combination thereof. Thus, it should be appreciated that pulling a metal band down tight over a reverse curve type of form will not apply any pressure to sections of the laminations that are between two convex sections of the form.

Yet another disadvantage of both of the above techniques is that they do not lend themselves to the even application of pressure along the entire length of the form. While this is especially true with reverse-curve forms, as explained above, it is also true with standard convex forms, especially those that are especially peaked at one point. Greater pressure tends to be applied to the vertex of the form than at the ends. This problem can be overcome to a certain extent by splitting the convex and concave forms into a number of segments and clamping each segment independently or by applying radial pressure to a flexible band used in place of a concave form. Alternately, the problem of even pressure can be overcome by applying fluid pressure to one side of the laminations, such as by positioning an inflatable hose or bag between the flexible band and the outer surface of the laminations.

Another consideration in forming laminated wood structures is the type of adhesive used to hold the individual laminates together. The setting to shape of laminated curves is essentially a process of glue-setting, and the method used will therefore depend to a large extent on the type of glue. Most older types of glues, such as animal or vegetable glues, are applied hot, and in most cases it is essential to ensure that the glue has cooled completely before the curved lamination can be removed from the form without fear of delamination or glue failure. Normally, with glues of this type, the curved laminations remain pressed to shape overnight or at least for several hours.

Newer synthetic glues, such as caseins and synthetic resins, are advantageous because they involve much less setting time. These glues set by virtue of chemical changes and/or loss of moisture, both of which can be accelerated by increasing the temperature of the glue. Heat can be applied to laminated wood in a variety of ways, such as by employing electrical resistance heating strips.

Perhaps the most commonly used method of heat-setting glues in laminations is by high frequency or radio frequency (RF) energy. RF energy essentially cooks the glue, similarly to how a microwave oven cooks food, by causing water molecules in the glue to vibrate and thereby produce frictional heat. RF energy is typically transmitted through wood laminations by a pair of terminals, one positive and one negative, which are positioned on opposite sides of the laminations. For example, with a form that consists of a convex form and a flexible metal strap, the convex form is covered by a metal layer so as to serve as one terminal, whereas the metal strap serves as the opposite terminal. Both terminals are connected to a conventional RF generator, which transmits RF energy through the lamination, including the glue, after the lamination has been pressed into shape in the form.

Several United States Patents disclose various devices for forming curved laminated wood structures. U.S. Pat. No. 4,967,816 to Postema discloses a method and apparatus for fabricating arcuate wooden structures that includes a frame structure with a mandrel mounted thereon that acts as a convex form. Unlike conventional solid forms, the mandrel of Postema has a variable radius so that the device can produce laminated wood structures of different shapes and sizes. A flexible band serves as the concave portion of the form for pressing the wood laminations down over the adjustable mandrel. The disclosed method involves placing adhesive between the strips of wood and then progressively applying pressure around the mandrel by unrolling the flexible band from one end of the device to the other. The Postema patent gives no indication as to the exact type of adhesive contemplated for use with this invention.

U.S. Pat. No. 4,156,805 to Gillet discloses a machine that laminates long strips of wood together while imparting a slight curve to the finished structure. The machine includes two electrodes connected to a high frequency current generator for heating the wood strips and glue. A plurality of pairs of electrically insulated rollers exert pressure on opposite sides of the laminated structure, and at least one pair of rollers is movable with respect to the others to curve the structure as heat treatment proceeds.

U.S. Pat. No. 3,943,025 to Russell discloses a laminating press that includes tread plates on mutually opposed endless belts, which clamp and move boards between electrodes for setting adhesive between the boards by dielectric heating. The tread plates include plastic surfaces to deter passage of RF energy through the plates. The endless belts can be curved to slightly bend the laminated boards lengthwise.

Other patents that disclose various devices and methods for forming curved and flat laminations of various sorts include the following: U.S. Pat. No. 5,133,822 to Fujii et al.; U.S. Pat. No. 3,191,522 to Drake et al.; U.S. Pat. No. 3,056,440 to Mello; U.S. Pat. No. 2,705,993 to Mann et al.; U.S. Pat. No. 2,597,923 to Croston; U.S. Pat. No. 2,571,604 to Payzant; U.S. Pat. No. 2,433,067 to Russell; and U.S. Pat. No. 2,324,068 to Crandell.

SUMMARY AND OBJECTS OF THE INVENTION

In view of the above, a primary object of the present invention is to provide a machine and method for forming curved laminations of varying shapes and sizes with a single laminating machine.

Another object of the present invention is to provide a laminating machine and method as set out above that forms curved laminations of varying shapes and sizes without the need to re-set, adjust, or modify the machine.

A further object of the present invention is to provide a machine and method for continuously laminating wood strips to form varying shapes and sizes of arched window and doorway headers, frames and the like.

Yet another object of the present invention to provide a laminating machine and method as set out above that uses RF energy to cure glue between individual laminates while simultaneously pressing the laminates into a predetermined shape.

Still another object of the present invention is to provide a laminating machine and method as set out above that can form laminations having multidirectional reverse curves just as easily as laminations having unidirectional curves.

Still a further object of the present invention is to provide a laminating machine and method that can be used to cost-effectively produce custom-designed laminated structures such as custom-designed arched window and doorway headers.

An additional object of the present invention is to provide a custom-designed curved laminated structure having a curved lamination with an predetermined curved shape, which is bounded by at least one and preferably two opposing template flanges.

Another object of the present invention is to provide a curved laminated structure, as described above, wherein the template flanges include laminate retainers that impart the predetermined shape to the laminates held therein.

The present invention achieves these and other objects by providing a machine and method for forming curved laminations made of a plurality of individual laminates bonded together by an adhesive. The machine of the present invention comprises a support frame, a generally cylindrical RF-conducting capstan rotatably mounted in the support frame, and an RF-conducting anvil supported by the support frame in opposing relation to the capstan. An RF energy source is operatively connected to the capstan, and a ground terminal is operatively connected to the anvil.

Whereas previously designed laminating devices and methods use specialized forms that can only be used to form a single shape of lamination, the machine and method of the present invention utilizes custom template flanges that serve both as an element of the machine of the invention to determine the lamination's curved shape in addition to a component of the completed laminated structure. To perform both of these tasks, each template flange includes a laminate retainer for holding a foundation laminate in a predetermined curved shape. Additional structural laminates are laminated onto facing surfaces of the foundation laminate so that the lamination thus formed assumes the predetermined curved shape of the foundation laminate.

During operation of the laminating machine of the invention, a lamination passage defined between the capstan and the anvil receives the foundation laminate and structural laminates disposed in generally facing engagement with the foundation laminate. As the capstan rotates, the individual laminates are fed through the lamination passage where they are pressed together into a curved lamination. At the same time, RF energy is transmitted across the lamination passage from the rotating capstan to the anvil to heat-cure adhesive applied to facing surfaces of the laminates.

The machine and method of the present invention can be used to form curved laminations having an unlimited variety of shapes. For example, the template flanges and the lamination may have a unidirectionally curved shape, or a closed loop. Preferably, the template flanges are made of wood so as to serve as components of a wooden laminated structure that may be custom-designed much more cost-effectively than with previously existing laminating devices and methods.

Therefore, one aspect of the present invention entails a machine for forming laminations made of a plurality of individual laminates bonded together by an adhesive, the machine comprising: (a) a support frame; (b) a generally cylindrical capstan rotatably mounted in the support frame; (c) an anvil supported by the support frame in opposing relation to the capstan, wherein the capstan and the anvil define a lamination passage therebetween for receiving a foundation laminate and at least one structural laminate disposed in generally facing engagement with the foundation laminate, and wherein the capstan rotates on a longitudinal axis thereof so as to move the laminates through the lamination passage and thereby press the laminates together into a lamination; and (d) at least one template flange including a laminate retainer for holding the foundation laminate in a predetermined shape as the laminates are moved through the lamination passage and pressed together so that the lamination formed by the machine assumes the predetermined shape of the foundation laminate.

In a preferred embodiment, the capstan and the anvil both comprise a material that conducts RF energy. Hence, the machine of the invention preferably includes an RF energy source operatively connected to the capstan and a ground terminal operatively connected to the anvil, whereby RF energy is transmitted across the lamination passage to heat-cure adhesive applied to facing surfaces of the laminates.

The anvil may take on any form that serves as a surface in opposition to the capstan. In a preferred embodiment of the laminating machine of the invention, the anvil comprises a roller wheel rotatably mounted in the support frame, whereby the capstan and the roller wheel together form a pinch-roller mechanism. In an alternate embodiment, the anvil comprises an elongated table having a generally planar surface facing the capstan and extending in a longitudinal direction generally perpendicular to the longitudinal axis of the capstan. Preferably, at least one of the capstan and the table is movable in the longitudinal direction of the table relative to the other. In yet another alternate embodiment, the anvil comprises two roller wheels rotatably mounted in the support frame proximate to the capstan, an endless band disposed around the two roller wheels, and means for tensioning the band.

While a single template flange will suffice in some instances, the machine preferably includes two mirror-image template flanges that hold the foundation laminate therebetween. Likewise, the laminate retainer preferably comprises a groove extending along an inner surface of each template flange, whereupon each groove engages an opposing side edge of the foundation laminate.

In the preferred embodiment, there is provided means for permanently bonding the foundation laminate to the template flanges, whereby the template flanges form part of a laminated structure that includes the lamination, which in turn includes a plurality of individual laminates. This means preferably includes adhesive bonds between side edges of the foundation laminate and the grooves in the template flanges. In the alternative, however, the template flanges may only releasably hold the foundation laminate, whereby the completed lamination can be disengaged from the template flanges after being formed. With this arrangement, the template flanges can be reused to form a plurality of laminations having the predetermined shape.

Another aspect of the present invention entails a method of forming laminations made of a plurality of individual laminates bonded together by an adhesive, the method including the steps of: (a) providing a template flange that includes a laminate retainer; (b) shaping a foundation laminate into a predetermined shape; (c) engaging the shaped foundation laminate with the laminate retainer of the template flange so that the laminate retainer holds the foundation laminate in the predetermined shape; (d) positioning at least one structural laminate in generally facing engagement with the foundation laminate held by the laminate retainer; (e) applying adhesive in between facing surfaces of the foundation laminate and the at least one structural laminate; and (f) pressing the laminates together while holding the foundation laminate in the predetermined shape, thereby forming a lamination that assumes the predetermined shape of the foundation laminate.

In addition, the method of the invention preferably includes applying heat-curable glue in between facing surfaces of the foundation laminate and the structural laminates and transmitting RF energy through all of the laminates to heat-cure the glue. This preferably occurs at the same time that the laminates are pressed together. While a single template flange may be used to carry out the method of the invention, the method preferably includes providing a second, mirror-image template flange and engaging the shaped foundation laminate with a laminate retainer of the second template flange so that the two template flanges hold the foundation laminate therebetween in the predetermined curved shape.

Preferably, the method of the invention also includes the step of cutting a groove into a surface of the template flange according to the predetermined shape, whereby the groove forms the laminate retainer. The step of shaping the foundation laminate may include shaping the foundation laminate into a unidirectional curve, a multidirectional curve, or a closed loop.

Also, the method of the invention preferably includes permanently engaging a side edge of the foundation laminate with the laminate retainer, whereby the template flange or flanges become components of a laminated structure that includes the lamination formed according to the method. This step is preferably carried out by forming an adhesive bond between the side edge of the foundation laminate and grooves cut into inner surfaces of the template flanges. In the alternative, the shaped foundation laminate may be releasably engaged by the laminate retainer and then disengaged therefrom after the lamination is formed. The template flange may then be reused to form a plurality of laminations having the predetermined shape.

Yet another aspect of the present invention entails a laminated structure, comprising: at least one generally planar template flange including a laminate retainer on a surface thereof; and a curved lamination attached to the at least one template flange, the lamination including (i) a foundation laminate attached to the laminate retainer of the template flange and maintained in a predetermined curved shape by the laminate retainer, (ii) at least one structural laminate disposed adjacent to the surface of the template flange in generally facing engagement with the foundation laminate, and (iii) an adhesive disposed in between facing surfaces of the foundation laminate and the at least one structural laminate, wherein the adhesive maintains the at least one structural laminate in the predetermined curved shape against the foundation laminate.

The laminate retainer preferably comprises a groove cut into the surface of the template flange according to the predetermined shape, which engages a side edge of the foundation laminate. In addition, the groove is preferably disposed proximate and generally parallel to a bottom edge of the template flange.

To ensure that the foundation laminate is securely held in the predetermined shape, the laminated structure preferably includes two generally parallel template flanges that maintain the foundation laminate generally perpendicularly therebetween. The predetermined shape of the foundation laminate may be, for example, a unidirectionally curved shape, a multidirectionally curved shape, or a closed loop.

Other aspects and advantages of the present invention will become apparent and obvious from a study of the following description and the accompanying drawings, which are merely illustrative of the invention.

DETAILED DESCRIPTION OF THE INVENTION

Figure 1:
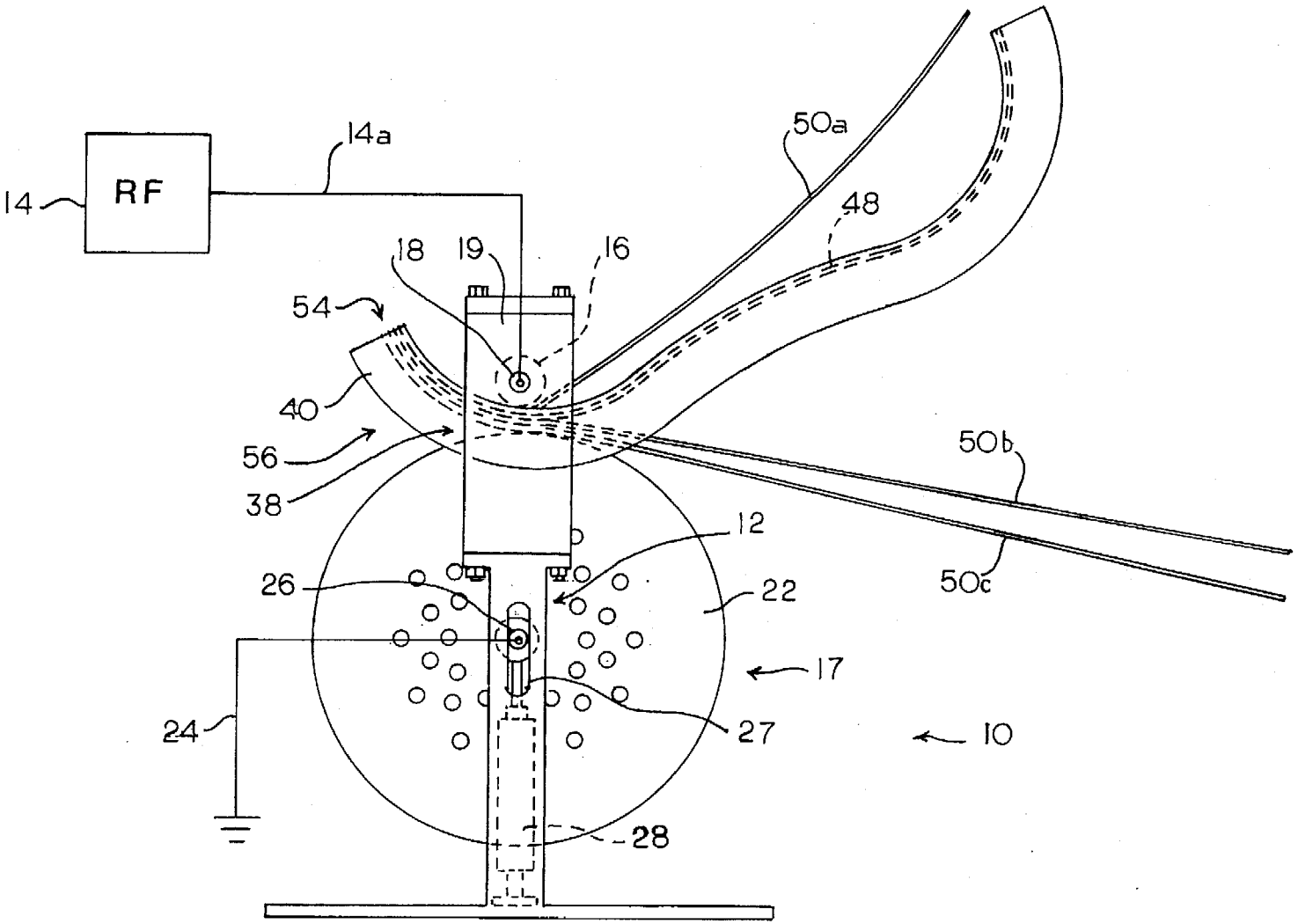
FIG. 1 is schematic side view of a preferred embodiment of the laminating machine of the present invention, shown here forming a reverse-curved lamination according to a preferred method of the invention.

The present invention is described more fully hereinafter by referring to the drawings, in which preferred embodiments are depicted. However, the present invention can take on many different embodiments and is not intended to be limited to the embodiments described herein.

Figure 2:
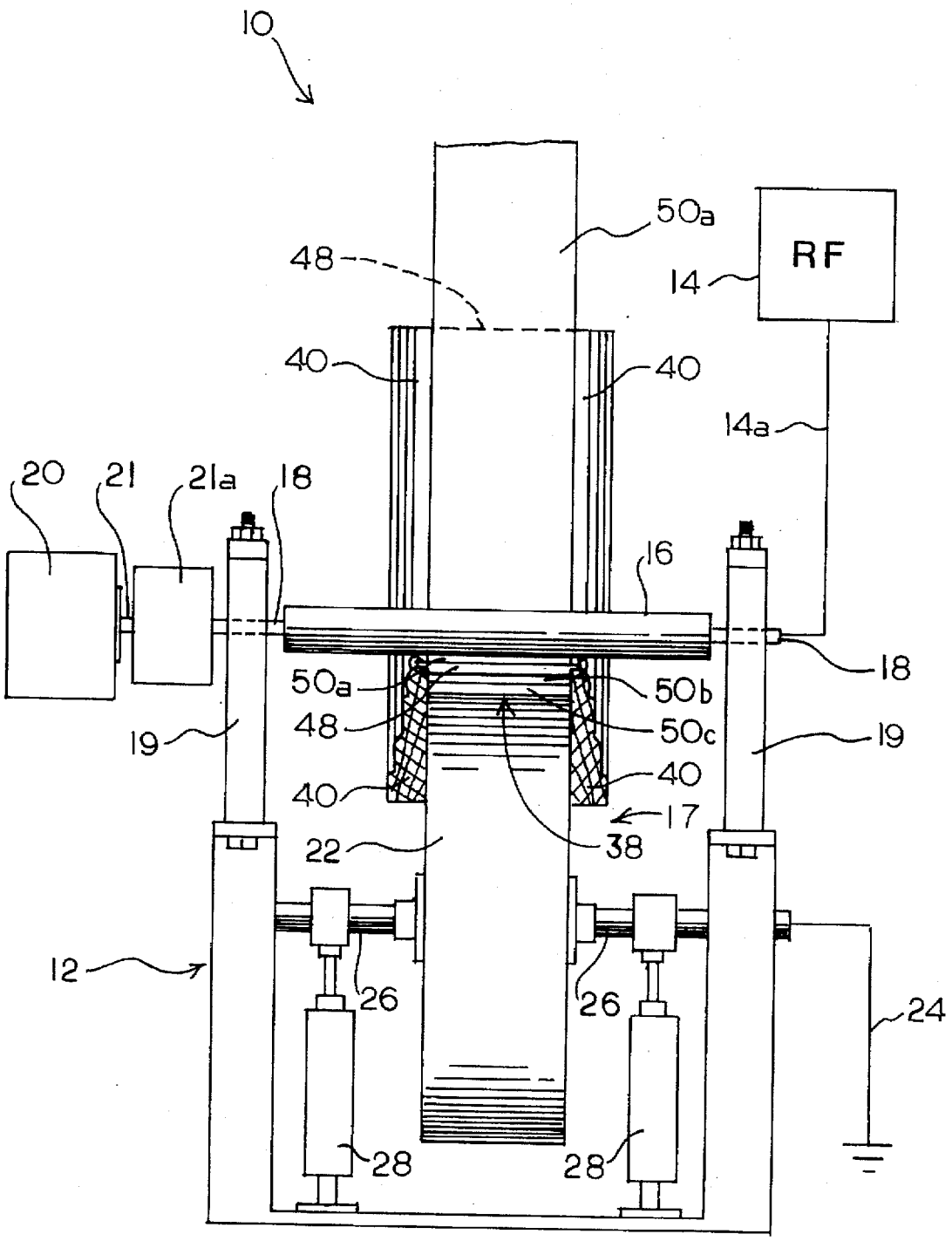
FIG. 2 is an end view, looking upstream, of the laminating machine depicted in FIG. 1, shown here initiating the formation of a curved lamination according to the method of the invention.
Figure 3:
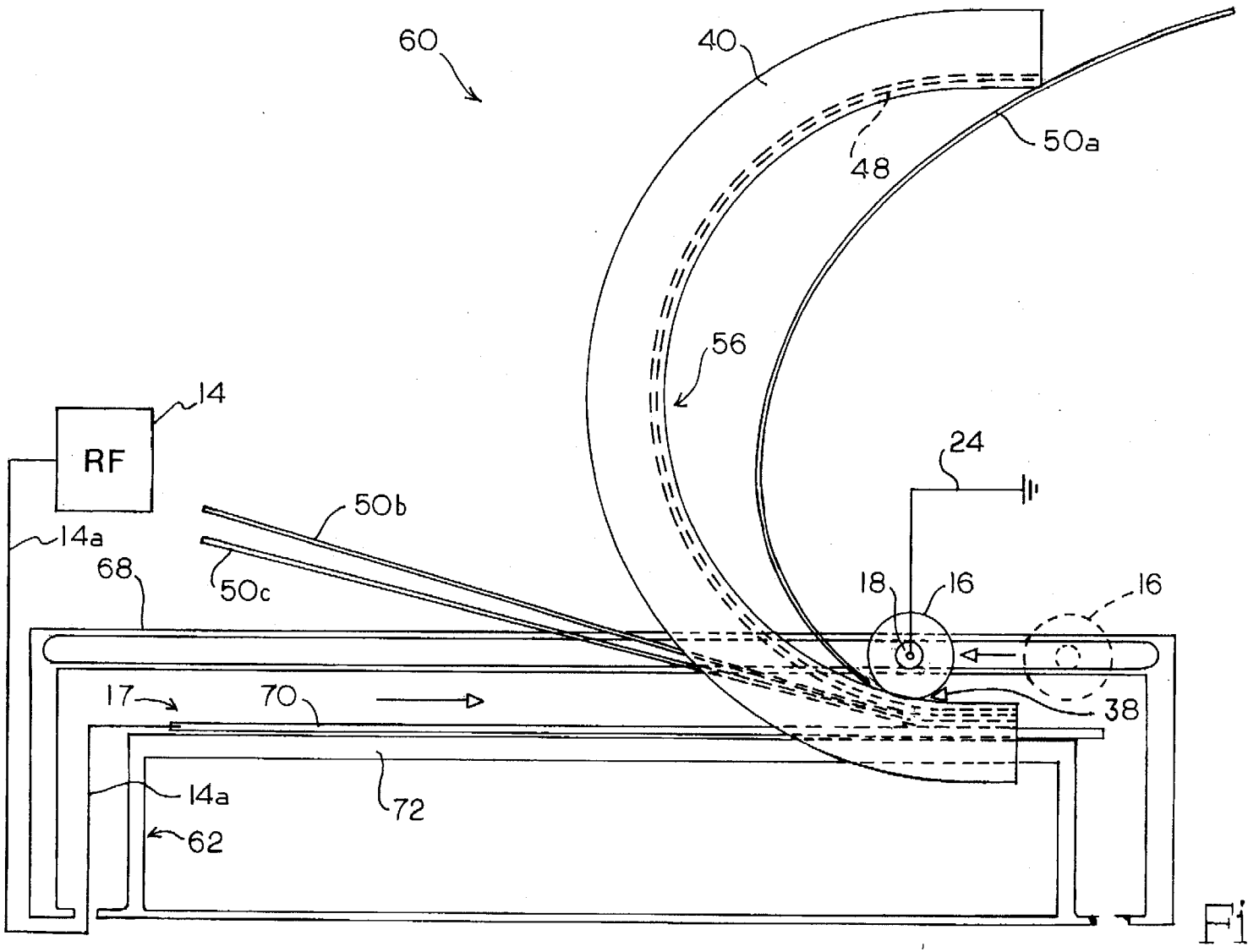
FIG. 3 is a schematic side view of a first alternate embodiment of the laminating machine of the present invention, shown here initiating the formation of a unidirectionally curved lamination according to the method of the invention.
Figure 4:
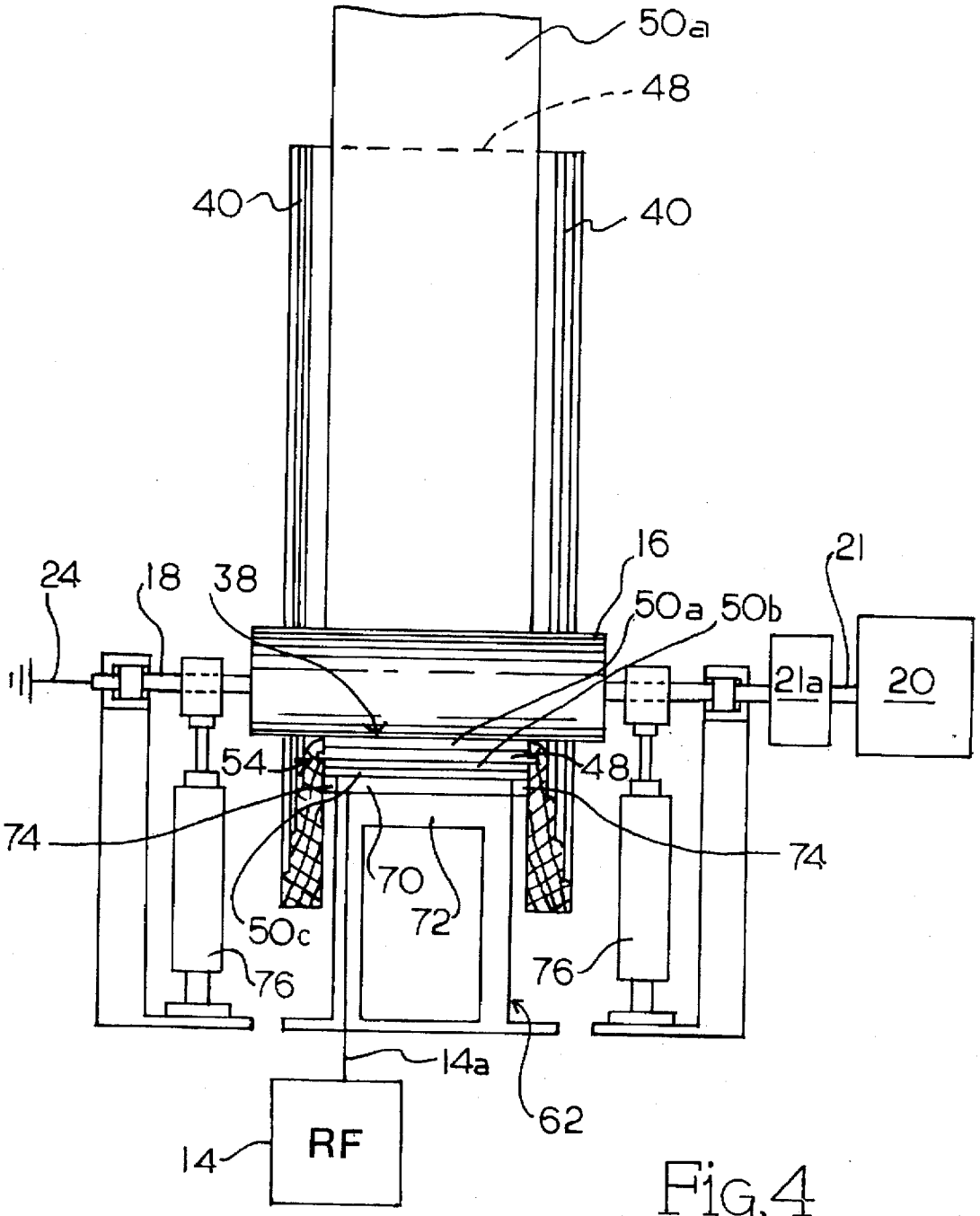
FIG. 4 is a schematic end view, looking downstream, of the laminating machine depicted in FIG. 3.
Figure 5:
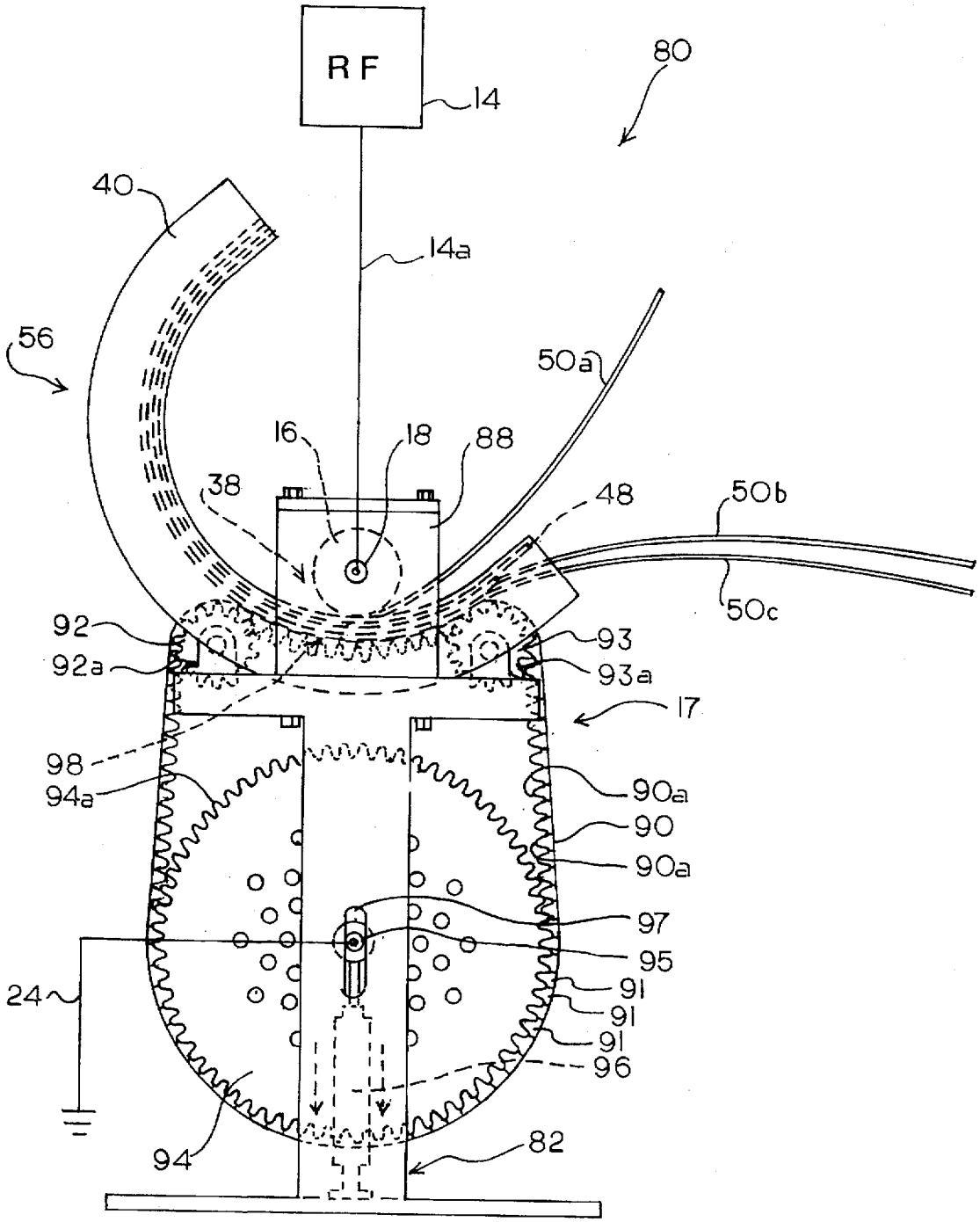
FIG. 5 is a side view of a second alternate embodiment of the laminating machine of the present invention, shown here initiating the formation of a unidirectional curved lamination according to the method of the invention.

Referring now to the drawings, a preferred embodiment of a laminating machine, generally designated with the numeral 10, is shown in FIGS. 1–2 constructed according to the present invention for forming curved laminations. An alternate embodiment of the laminating machine of the invention, generally designated with the numeral 60, is shown in FIGS. 3 and 4. Yet another alternate embodiment of the laminating machine of the invention, generally designated with the numeral 80, is shown in FIG. 5. Examples of curved laminated structures that can be formed with curved laminations produced using any embodiment of the laminating machine of the invention include arched doorway and window headers and frames and rounded window frames.

For purposes of simplicity, most common components of all the various embodiments of the laminating machine of the invention will retain the reference numbers used to describe the embodiment shown in FIGS. 1–2. Each embodiment of the laminating machine of the invention, including that depicted in FIGS. 1–2, generally includes four main components: a support frame 12; a capstan 16 rotatably mounted in the support frame 12; an anvil 17, the structure of which varies among the several embodiments, which is supported by the support frame 12 in opposing relation to the capstan 16; and at least one template flange, generally designated 40, which determines the shape of a lamination formed by the machine 10 of the invention.

In all of the embodiments depicted herein, including the embodiment 10 depicted in FIGS. 1–2, the capstan 16 is generally cylindrical and rotates about its longitudinal axis in the support frame 12. Preferably, the capstan 16 includes axles 18 extending from each end that are rotatably secured in bushings 19 attached to the frame 12. In the embodiment of the laminating machine 10 shown in FIG. 1, the capstan 16 occupies a stationary location relative to the support frame 12; however, in alternate embodiments of the laminating machine, the capstan 16 is movably mounted in the support frame 12.

As shown best in the end view of FIG. 2, the capstan 16 is driven by a drive motor 20 operatively connected to the capstan 16 by a drive shaft 21. The drive motor 20 depicted in the drawings is shown as being of the direct-drive type; however, it would be within the expertise of one skilled in the art to provide a drive motor linked to the capstan 16 by a drive belt or chain. Further, gears or a transmission could be provided to vary the rotational speed of the capstan 16.

Together, the capstan 16 and the anvil 17 define a lamination passage 38 therebetween for receiving relatively thin individual laminates and pressing them together into a solid completed lamination 54. To ensure that adequate pressure is applied to the laminates, the laminating preferably includes a clamping mechanism that moves the capstan 16 and the anvil 17 towards each other, thereby narrowing the lamination passage 38. Depending on the embodiment of the laminating machine, the clamping mechanism may move the capstan towards the anvil, the anvil towards the capstan, or a combination thereof. In any case, the clamping mechanism moves the machine between an open position, whereby the lamination passage 38 has a first width, and a clamped position, whereby the lamination passage 38 has a second, narrower width. Preferably, the clamped position is variable so that varying thicknesses of laminations can be accommodated in the lamination passage 38.

During operation of all embodiments of the laminating machine of the invention, a foundation laminate 48 is held in a predetermined shape by one or more template flanges 40. Then, the foundation laminate 48 and at least one structural laminate, generally designated 50, which is disposed in facing engagement with the foundation laminate 48, are moved through the lamination passage 38 and pressed together so that the resulting lamination formed by the machine 10 assumes the predetermined shape of the foundation laminate 48. In the drawings, three structural laminates **50*a*, 50*b*, and 50*c* are shown, structural laminate 50*a* being disposed on one side of the foundation laminate 48 and structural laminates 50*b* and 50*c* being disposed on the opposite side of the foundation laminate 48. However, it should be apparent that the machine and method of the present invention do not depend on the exact number of laminates or on their exact configuration relative to each other. To carry out the present invention, a single foundation laminate 48 and a single structural laminate 50 could be provided; or, in the alternative, more than three structural laminates 50 could be provided. In addition, the structural laminates 50 can be varyingly disposed on opposite sides of the foundation laminate 48** or all on one side thereof.

To hold the individual laminates 48, 50 securely together in a solid lamination 54, a suitable adhesive is applied to facing surfaces of the laminates 48, 50 to form glue joints 52 between the individual laminates. Although any adhesive known to those in the laminating arts could be used, a quick setting adhesive is preferred and a heat-curable adhesive is most preferred, especially in woodworking applications. During operation, it is conceivable that a cold-setting adhesive, such as an epoxy, could be used in conjunction with any embodiment of the laminating machine of the present invention. However, as mentioned above, the individual laminates 48, 50 are preferably bonded together with a heat-curable glue. Such glues are well known and are commonly cured by transmitting RF energy through laminates having the heat-curable glue applied therebetween.

Accordingly, each embodiment of the laminating machine of the present invention preferably includes an RF energy source 14 operatively connected to either the capstan 16 or the anvil 17 and a ground terminal 24 operatively connected to the other of the capstan 16 or the anvil 17. Preferably, the RF energy source is connected to the capstan 16 and the ground terminal 24 is connected to the anvil 17. Thus, the capstan 16 constitutes the "hot" side and the anvil and the support frame constitute the "ground" side of the machine. During operation of the laminating machine according to the method of the invention to be more fully discussed below, RF energy is transmitted across the lamination passage 38 to heat-cure the glue applied to facing surfaces of the laminates 48, 50. It should be apparent then that the capstan 16 and the anvil 17 both include a material that conducts RF energy, such as non-ferrous metal. Any conventional frequency of RF energy may be used to heat-cure the glue in the laminating machine and method of the present invention.

In all embodiment of the laminating machine, the RF energy source is shown operatively connected to the capstan by a cable 14*a* attached to one of the capstan axles 18. To isolate the capstan 16 from the rest of the laminating machine, the bushings 19 in which the capstan 16 is rotatably mounted in the support frame are preferably made of a substantially non-conductive material such as wood. In addition, the drive shaft 21 from the drive motor 20 to the capstan 16 preferably includes a barrier section 21*a* for preventing the transmission of RF energy through the drive shaft 21 to the drive motor 20.

Now, turning to the structure of the various embodiments of the laminating machine, in the preferred embodiment of the laminating machine 10 depicted in FIGS. 1–2, the anvil 17 is in the form of a roller wheel 22 rotatably mounted in the support frame 12 by roller wheel axles 26 extending from both sides of the roller wheel through a section of the frame 12. In this embodiment, the lamination passage 38 is found between the capstan 16 and the roller wheel 22. Therefore, the capstan 16 and the roller wheel 22 together somewhat resemble the pinch-roller mechanism found in a magnetic tape recorder. As the capstan 16 rotates on its longitudinal axis, the laminates 48, 50 are moved through the lamination passage 38 and pressed together into a solid lamination 54, best seen from the end view of FIG. 2. As an example, FIG. 1 depicts the laminating machine 10 forming a reverse-curved lamination 54 by employing at least one template flange 40 having a reverse-curved shape.

In the embodiment of the laminating machine 10 shown in FIGS. 1–2, the capstan 16 preferably occupies a stationary location relative to the support frame 12. Therefore, the clamping mechanism in the preferred embodiment of the lamination machine 10 preferably moves the roller wheel 22 towards the capstan 16 to narrow the lamination passage 38 and clamp the laminates therein. While the clamping mechanism may embody any device that imparts linear motion, the clamping mechanism preferably includes fluid cylinders 28 disposed between the support frame 12 and the roller wheel axles 26. These fluid cylinders 28 may be pneumatic or hydraulic cylinders, depending on a particular user's capabilities. The operation of fluid cylinders is well known to those skilled in the art; therefore, the operation of the fluid cylinders 28 will not be discussed in detail. As shown in the FIGS. 1 and 2, the roller wheel axles 26 are disposed in slots 27 in the support frame 12. Therefore, when the fluid cylinders 28 are actuated, the roller wheel 22 is raised or lowered in the frame between the open position and the clamped position. One reason that fluid cylinders are preferred is because they readily adapt to different thicknesses of laminations 54 in the lamination passage 38.

As depicted in FIG. 2, the capstan 16 is wider than the roller wheel 22, although they could have the same width. Preferably, the roller wheel 22 is approximately the same width as typical door or window frame jambs, as those are typical structures formed by the machine 10. For example, the preferred roller wheel 22 could be approximately 4 inches to 16 inches wide. As carpenters and home builders know, however, many door and window frames are narrower or wider than 4½ inches. Therefore, two means are provided in the present invention for changing the effective width of the roller wheel 22.

First, the laminating machine 10 may include a plurality of interchangeable roller wheels of different sizes. For example, a set of roller wheels having widths of 4½, 5½, 7½, and 9½ inches could be provided. The laminating machine 10 could then be changed-over between projects by removing on roller wheel and installing another.

Second, to eliminate the need for changing over the machine to use a different roller wheel, the effective width of the roller wheel 22 can be increased with an optional elongated anvil plate 36 having a greater width than the roller wheel 22. Seen in FIG. 1A, the elongated anvil plate 36 is a substantially rigid member disposed in the lamination passage 38 overlying the roller wheel 22 between the roller wheel 22 and the laminates. Preferably, the anvil plate 36 is constructed of a metal such as aluminum to provide the proper rigidity necessary to serve as an anvil and to conduct RF energy and thereby serve as a part of the ground. By using the anvil plate 36, even pressure is applied to laminates having greater widths than the roller wheel 22. The anvil plate 36 could be any desired width to accommodate varying laminates.

The ground terminal 24 is operatively connected to the roller wheel 22. Although the ground terminal 24 is shown attached to one of the roller wheel axles 26, the ground terminal 24 could just as easily be attached to any part of the support frame 12 having electrical continuity with the roller wheel 22.

Another reason that the roller wheel 22 preferably has a particularly large radius compared to the capstan 16 is so that the surface contact area or "footprint" between the roller wheel and the lamination 54 clamped in the lamination passage 38 is maximized. By spreading the clamping pressure out over a larger area of the lamination 54, more even pressure can be applied and smoother, more evenly glued laminations 54 will result than if the roller wheel 22 had a small diameter compared to the capstan 16. From this standpoint, the larger the roller wheel 22 the better, except that the radius of a reverse curve in the curved lamination being formed by the machine 10 is limited by the radius of the roller wheel 22. It should be appreciated from an understanding of the inventive method set out below that reverse-curved laminations 54 cannot be formed with the radius of the reverse-curved section of the lamination being smaller than the radius of the roller wheel 22.

While the radius of the roller wheel 22 does not significantly affect the transmission of the RF energy through the lamination 54, because the roller wheel 22 is on the "ground" side of the machine 10, the radius of the capstan 16 on the other hand does affect the transmission of the RF energy field, because it is on the "hot" side of the machine 10. The radius of the capstan 16 is preferably smaller than that of roller wheel 22. This effectively yields a pressure zone between capstan 16 and roller wheel 22 that has a greater area than the RF energy zone between the capstan 16 and roller wheel 22.

Figure 1A:
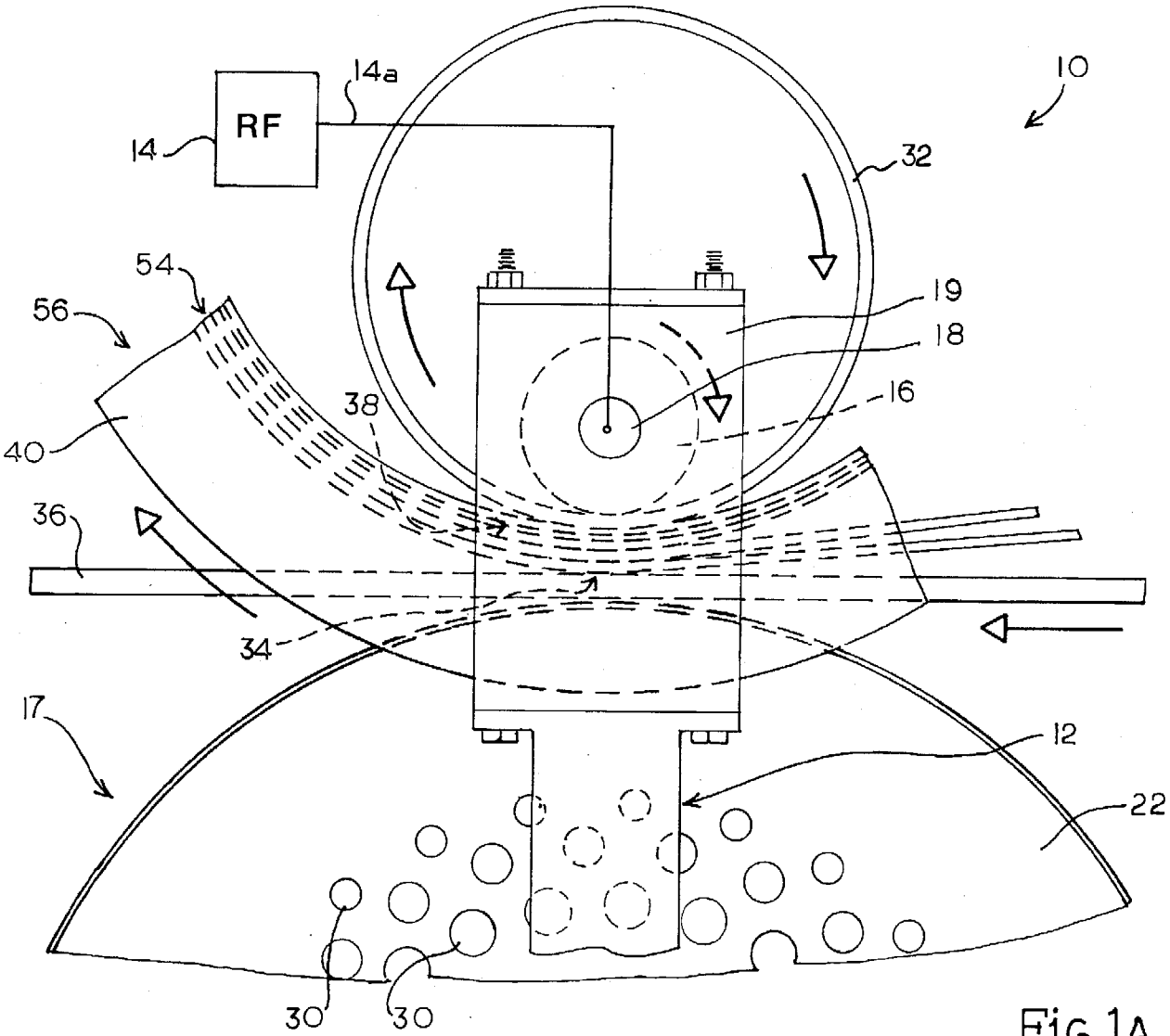
FIG. 1A is an enlarged side view of the lamination passage of the laminating machine depicted in FIG. 1, shown here utilizing an optional capstan sleeve and elongated anvil plate in forming a curved lamination according to the method of the invention.

However, for purposes of applying even pressure to the laminates over a large surface contact area, a large-radius capstan 16 is preferable. To overcome what would otherwise be a compromise between effectiveness of RF transmission and capstan footprint area, the machine 10 of the invention may be equipped with an optional cylindrical capstan sleeve 32 having a greater radius than the capstan 16. FIG. 1A shows the capstan sleeve 32 disposed around the capstan 16. In the preferred embodiment, the capstan sleeve 32 has a cylindrical inner void of greater radius than the capstan 16, whereby the capstan 16 rotates against the inner wall of the capstan sleeve 32 such that the capstan 16 and the capstan sleeve 32 are eccentric relative to one another. As can be seen, the larger radius of the capstan sleeve 32 increases the surface contact area 34 or "footprint" between the capstan 16 and the lamination 54. Thus, the capstan sleeve 32 spreads out the pressure applied from the capstan to the lamination 54 in the lamination passage 38 without significantly increasing the distance between the capstan 16 and the heat-curable glue between the laminates 48, 50. For the capstan sleeve 32 to achieve this result without dissipating the RF energy transmitted from the capstan 16, the capstan sleeve 32 is preferably composed of a material that allows the passage of RF energy therethrough, but does not enlarge the transmitting area of the capstan 16. A preferred material for the capstan sleeve 32 is a plastic such as PVC. In fact, the capstan sleeve 32 is preferably formed from a section of PVC pipe cut to approximately the same length as the capstan 16. Thus, the large-radius capstan sleeve 32 serves essentially the same purpose as the large-radius roller wheel 22 without interfering with the transmission of RF energy by the capstan 16.

Now turning to FIGS. 3 and 4, these drawings depict a first alternate embodiment of the lamination machine, generally depicted by the numeral 60, which is shown here forming a lamination having a unidirectional curve according to the method of the invention. In this embodiment, instead of the roller wheel 22, the anvil 17 takes the form of an elongated table 70 having a generally planar surface facing the capstan 16 and extending in a longitudinal direction generally perpendicular to the longitudinal axis of the capstan 16. In this embodiment of the laminating machine 60, the lamination passage 38 is disposed between the capstan 16 and the planar surface of the table 70. The capstan 16 itself is preferably the same as it is in the embodiment of the machine 10 shown in FIGS. 1–2. The capstan 16 rotates on axles 18 supported by support frame 62. As with the embodiment shown in FIGS. 1–2, this embodiment 60 preferably includes an RF energy source 14 operatively connected to the anvil 17 (table 70) and a ground terminal 24 operatively connected to the capstan 16. As such, the anvil 17 is preferably insulated to isolate the "hot" side of the machine 60 from the "ground" side of the machine.

In the alternate embodiment of the laminating machine 60 shown in FIGS. 3 and 4, at least one of the capstan 16 and the table 70 is movable in the longitudinal direction of the table 70 relative to the other to thereby move the laminates through the lamination passage 38. This can be accomplished with one of at least three variations of the laminating machine 60: the table 70 is stationarily affixed to the support frame 62 while the capstan 16 moves between opposite ends of the table 70; the table 70 is longitudinally movable between two extreme positions while the capstan 16 occupies a stationary location relative to the frame 62; or a combination of the first two variations.

In the first variation, the table 70 is immovably affixed to the support frame 62. The capstan 16, however, reciprocates longitudinally between opposite ends of the table 70 on a capstan track mechanism 68 disposed above the table 70. In such a device, the lamination passage 38 moves along with the capstan 16, which rolls overtop of the laminates 48, 50. The exact configuration of the capstan track mechanism 68 is not depicted; however, one skilled in the art would know how to construct such a device.

In the second variation, the support frame 62 includes a longitudinal table track mechanism 72 extending in the longitudinal direction of the table 70 beneath the table. The table 70 is movable in the longitudinal direction thereof along the table track mechanism 72 between two extreme positions. As with the capstan track mechanism 68, the exact configuration of the table track mechanism 72 is not depicted; however, one skilled in the art would know how to construct such a device. In this second variation, the capstan 16 occupies a stationary location relative to the table track mechanism 72 and the frame 62. Thus, the table 70 moves in a generally tangential direction relative to the stationary capstan 16. As best shown in FIG. 4, two clamping mechanisms 76 attached to the frame 62 and to each axle 18 of the capstan 16 pull the capstan 16 down towards the table 70 to clamp the laminates 48, 50 therebetween.

The third variation involves a combination of the above two variation, wherein both the table 70 and the capstan 16 are moveable relative to the frame 62 and to each other. Such a machine includes both a capstan track mechanism 68 and a table track mechanism 72.

As shown in FIG. 4, the table 70 may include at least one laterally extending addition 74 for effectively widening the table 70 so that even pressure is applied to laminates 48, 50 having greater widths than the table 70. These additions 74 may be provided in various widths and may be attached to one or both sides of the table 70. It should be appreciated that these table additions 74 accomplish the same purpose as the elongated anvil plate 36, which may be used with the embodiment of the laminating machine 10 that includes a roller wheel 22. That is, they enable the laminating machine 60 to form especially wide curved laminations 54. It should also be appreciated that the auxiliary table additions 74 preferably extend alongside the table 70 throughout the entire length of the table 70. The usefulness of these table additions 74 is exemplified in FIG. 4, which depicts a particularly wide curved lamination 54 being formed in the laminating machine 60. Such a lamination 54 could be used with an particularly thick door or window frame, for example.

Now turning to FIG. 5, this drawing schematically depicts a second alternate embodiment of the lamination machine, generally designate with the numeral 80, which is depicted here forming a unidirectionally curved lamination 54 according to the method of the invention. In this embodiment, instead of roller wheel 22 or a table 70, the anvil 17 takes the form of an endless flexible band 90 disposed around two roller wheels 92, 93, which are rotatably mounted in support frame 82 proximate to the capstan 16. In this embodiment of the laminating machine 80, the lamination passage 38 is disposed between the capstan 16 and the outer surface of the endless band 90 between and somewhat above the roller wheels 92, 93.

As with the first alternate embodiment 60 of the laminating machine shown in FIGS. 3 and 4, the structure of the capstan 16 in this second alternate embodiment 80 shown in FIG. 5 is in most respects similar to capstan 16 in the embodiment shown in FIGS. 1–2. The capstan 16 rotates on axles 18, which are supported by support frame 82.

However, unlike embodiment 10, the capstan 16 in this embodiment 80 is preferably pulled downwardly by a clamping mechanism 88 towards the endless band 90 to clamp laminates therebetween. As in the other embodiments, this embodiment 80 preferably includes an RF energy source 14 operatively connected to the capstan 16 by a cable 14*a* and a ground terminal 24 operatively connected to the anvil 17 (band 90 and rollers 92, 93) or the support frame 82. As such, the capstan 16 is preferably insulated to isolate the "hot" side of the machine from the "ground" side of the machine 80. Likewise the drive shaft to the drive motor preferably includes an RF barrier. The drive motor and drive shaft are not shown in this embodiment 80, but it should be understood that they are substantially similar or identical to those in the first two described embodiments 10, 60.

As can be seen in FIG. 5, the two roller wheels 92, 93 and the capstan 16 are disposed in a generally triangular configuration, wherein the two roller wheels 92, 93 rotate on longitudinal axes that are generally parallel to the longitudinal axis of the capstan 16. As depicted in this embodiment, the two roller wheels 92, 93 are provided with teeth 92*a*, 93*a* around their respective outer surfaces; likewise, the endless flexible band 90 is provided with corresponding teeth 90*a* around its inner surface for engagement with the teeth 92*a*, 93*a* on the roller wheels 92, 93. However, other means for providing engagement between the band 90 and roller wheels 92, 93 could also be provided, such as corresponding frictional surfaces.

This embodiment of the laminating machine 80 also includes tensioning means for imparting tension to the band 90. This tensioning of the endless band 90 can be accomplished in at least two ways. First, the band tensioning means could include means for imparting opposite rotational torque to the two roller wheels 92, 93. For example, each roller wheel 92, 93 could include its own drive motor (not shown) and limited-slip clutch mechanism (not shown). These drive motors would impart opposite rotational torque to each roller wheel 92, 93 to ensure that the section of the band 90 between the roller wheels 92, 93 is pulled taught.

The second and preferably form of the band tensioning means is shown in FIG. 5. Here, a tensioner wheel 94 is rotatably mounted in the support frame 82 and engages the endless flexible band 90, preferably, from the inside of the band 90. The tensioner wheel 94 includes a biasing mechanism 96 attached to the support frame 82 that biases the tensioner wheel 94 into engagement with the band 90. As can be seen in the drawing, the biasing mechanism 96 biases the tensioner wheel 94 in a direction generally away from the two roller wheels 92, 93. The biasing mechanism 96, which may comprise a tension spring or a fluid cylinder or the like, is shown connected at a lower end to the frame 82 and at an upper end to an axle 95 of the tensioner wheel 94. The axle 95 moves up and down in a slot 97 in a section of the support frame 82 depending on the amount of force applied by the biasing mechanism 96. Like the roller wheels 92, 93, the tensioner wheel 94 preferably includes teeth 94*a* around its outer surface for engaging the teeth 90*a* on the inner surface of the band 90. In the alternative (not shown), the endless band could be much shorter, essentially surrounding only the two roller wheels 92, 93 and the tensioner wheel could be disposed outside the band generally between and below the roller wheels. In this case, the tensioner wheel would deflect the band upwardly in between the roller wheels. In either case, the result is the same: the endless band 90 is tensioned proximate the lamination passage 38 below the capstan 16.

The endless flexible band 90 can take on any of several embodiments. For example, the band 90 could be a generally smooth-surfaced continuous band made of reinforced fabric or an elastic compound such as rubber. Such a band would resemble a wide motor drive belt. However, in such a case, the band would not effectively serve as the ground for the RF energy transmitted by the capstan 16. Instead, the roller wheels 92, 93 would necessarily be operatively connected to the ground terminal.

In the depicted and preferred embodiment, the band 90 is shown including a series of adjacent segments 91, similar to a flexible watch band. In this embodiment, the band 90 more closely resembles a chain than a belt. The segments 91 preferably include conductive outer surfaces made of metal, for example, to provide a good ground for the RF energy. The segments 91 of the band 90 are therefore in electrical contact with the rest of the frame 82, to which the ground terminal 24 may be operatively connected.

In any configuration, the primary advantage of the second alternate embodiment 80 of the laminating machine is that the endless band 90 version of the anvil 17 creates an especially large surface contact area 98 or footprint with one side of the lamination 54. Instead of the relatively small contact surface area at the top of the roller wheel 22 or on the top surface of the table 70, the endless band 90 wraps around several inches of a curved lamination passing through the lamination passage 38. In essence, the endless band 90 in the embodiment 80 shown in FIG. 5 constitutes a self-forming, variable-shaped anvil. As will be explained more fully below in the discussion of the method of the present invention, the configuration of this embodiment 80 increases the length of time in which pressure is exerted on a given point of a lamination 54.

Figure 6A:
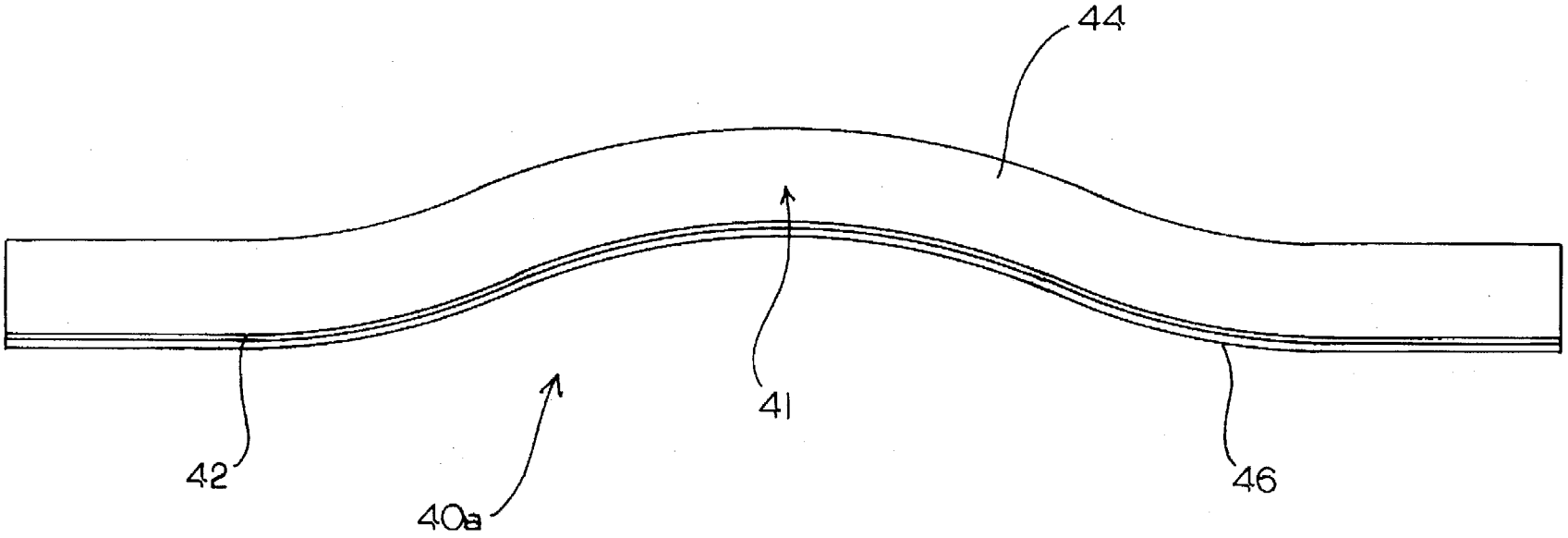
FIG. 6A depicts a template flange used to form a reverse-curved lamination according to the method of the invention.
Figure 6C:
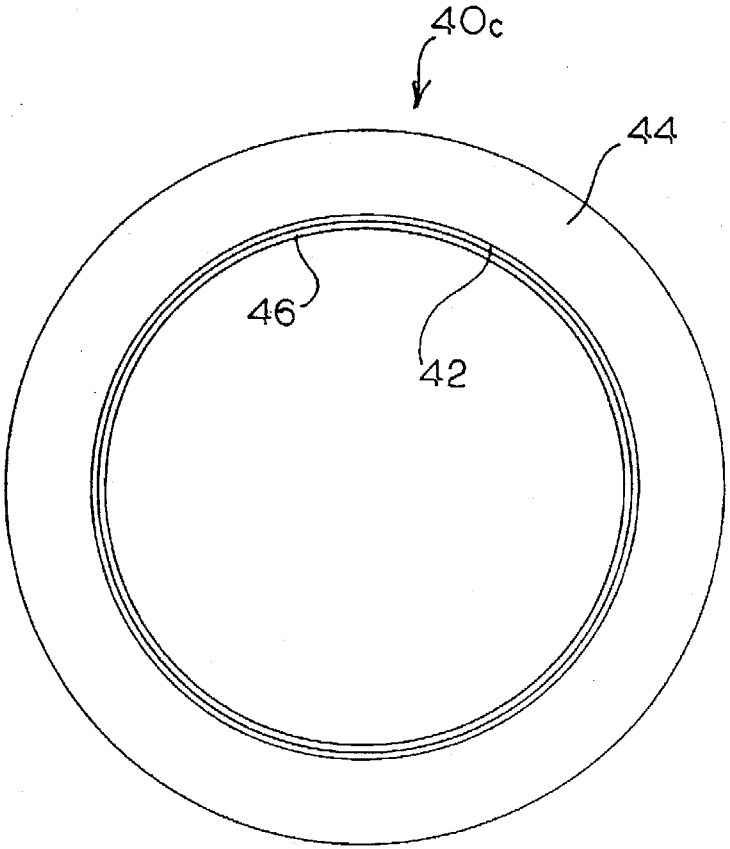
FIG. 6C depicts a template flange used to form a closed loop lamination according to the method of the invention.
Figure 6B:
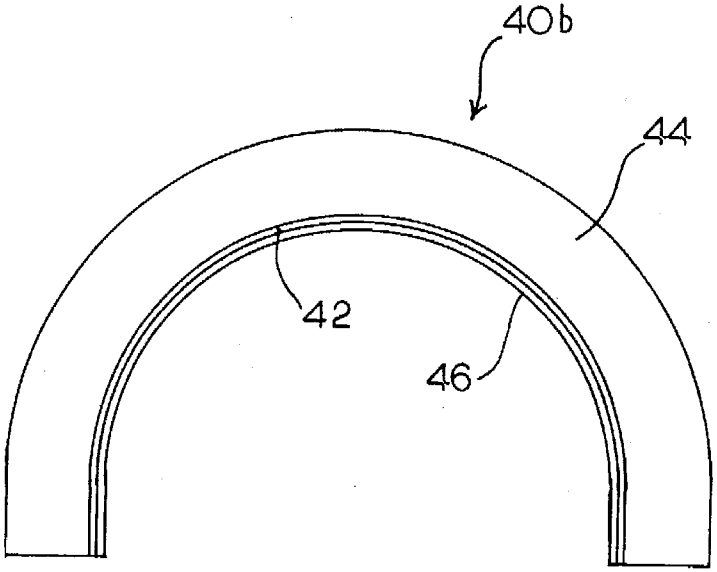
FIG. 6B depicts a template flange used to form a unidirectionally curved lamination according to the method of the invention.
Figure 7:
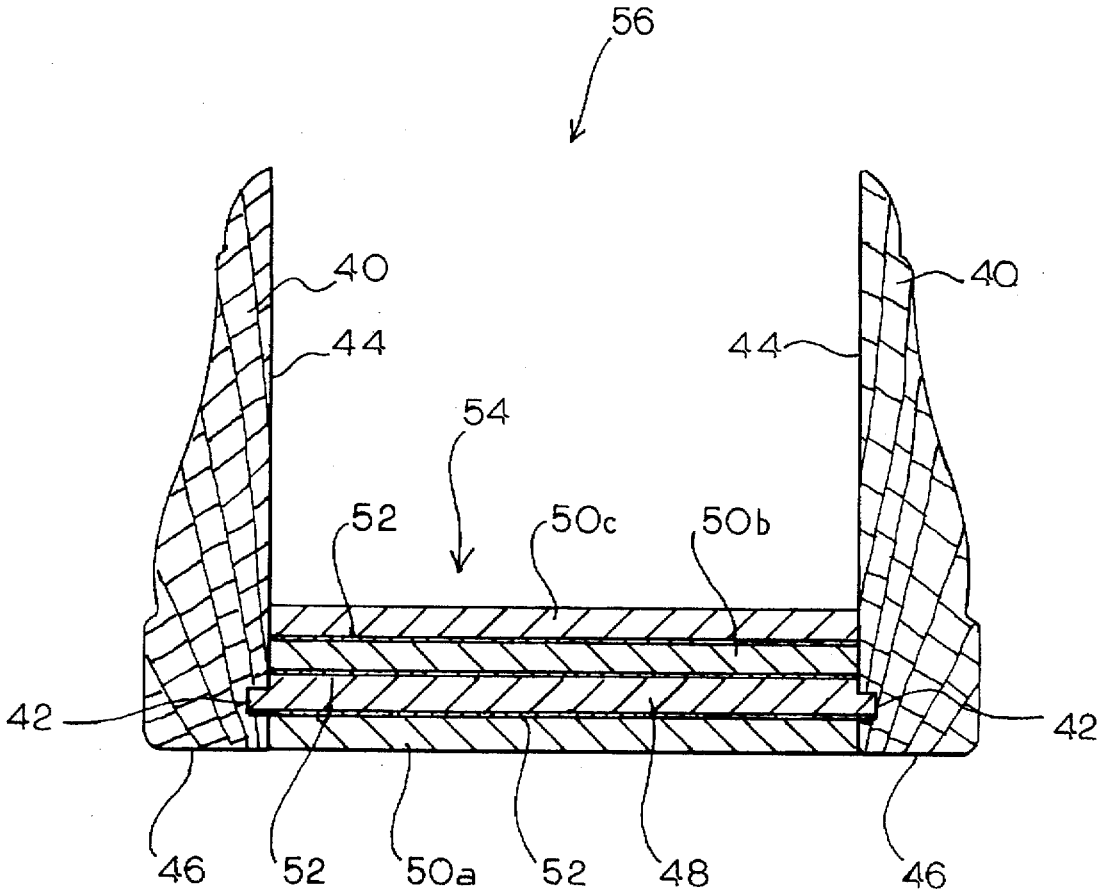
FIG. 7 depicts a cross-section of a completed laminated structure formed using the machine and method of the present invention.

Now turning to FIGS. 6A, 6B, and 6C, these drawings respectively depict various forms of template flanges 40*a*, 40*b*, and 40*c* that may be used to create various shapes of curved laminations 54. It should be understood that these drawings are only exemplary illustrations and are not intended to limit the invention in any way to these precise shapes. FIG. 6A depicts a template flange 40*a* having a multidirectional or reverse-curved shape, which likewise holds a foundation laminate in a multidirectionally curved shape. The reverse-curved section of template flange 40*a* is generally designated with the numeral 41. FIG. 6B depicts a template flange 40*b* having a unidirectionally curved shape, which holds a foundation laminate in a unidirectionally curved shape. FIG. 6C depicts a circular template flange 40*c*, which holds a foundation laminate in a circular shape. Other shapes of template flanges 40 could be provided with different shapes than those shown in the drawings. It is even contemplated that straight template flanges could be used with the machine and method of the invention to form linear laminations such as the side jambs of window and doorway frames. FIG. 7 depicts a cross-section of a completed laminated structure 56 formed using two of the template flanges.

To form curved laminations 54 using one of the embodiments of the laminating machine of the invention and template flanges 40 such as those depicted in FIGS. 6A–6C, either one or two template flanges 40 may be used. The machines 10 and 60, shown respectively in FIGS. 1–2 and 3–4, depict curved laminations 54 being formed using two template flanges 40, one on each side of the lamination 54. On the other hand, the machine 80 shown in FIG. 5 depicts a curved lamination 54 being formed using a single template flange 40 on only one side of the lamination 54. Preferably, two mirror-image template flanges 40 are used, which hold the foundation laminate 48 therebetween in the predetermined shape as the laminates 48, 50 are fed through the lamination passage 38. Providing two mirror-image template flanges 40 ensures that the foundation laminate 48, to which the structural laminates 50 are bonded, is accurately disposed perpendicular relative to the template flanges 40 and does not flex or distort away from the predetermined shape as the laminates 48, 50 are fed through the lamination passage 38. This is especially true with particularly wide laminations, such as the lamination shown in FIG. 4.

The template flanges 40 each include a laminate retainer for holding the foundation laminate 48 in the predetermined shape, which will ultimately give rise to the final shape of the completed lamination 54. In the preferred embodiment of the invention, the laminate retainer comprises a groove 42 extending along an inner surface 44 of each template flange 40. (See FIG. 7.) One of the side edges of the foundation laminate 48 fits into the groove 42, which thereby maintains the foundation laminate 48 in the same curved shape that the groove 42 defines in the surface of the template flange 40. As seen in the drawings, the groove 42 is preferably disposed proximate and generally parallel to a bottom edge 46 of the template flange 40. The reason for this is so that the facing surface of a structural laminate 50 will generally follow the contour of the template flange edge 46, even therewith, whereby the structural laminate 50 will be engaged by the capstan 16 as the laminates pass through the lamination passage 38. Therefore, the groove 42 could be centrally located on the surface 44 of the template flange if many structural laminates are provided to fill in the space between the groove 42 and the template flange edge 46.

The preferred composition of the template flanges 40 depends on the method by which they are used. As will be explained later more fully, the template flanges 40 can generally be used in one of two ways: they can be permanently bonded to the lamination 54 formed by the method of the invention, whereby the flanges 40 become a component of a completed laminated structure 56 that includes both the lamination 54 and the flanges 40; or they can be releasably engaged with the lamination 54, whereby the lamination 54 can be disengaged from the template flanges 40 after being formed. With this second method, the template flanges 40 can be reused to form a plurality of laminations 54 having the identical predetermined shape.

Figure 8:
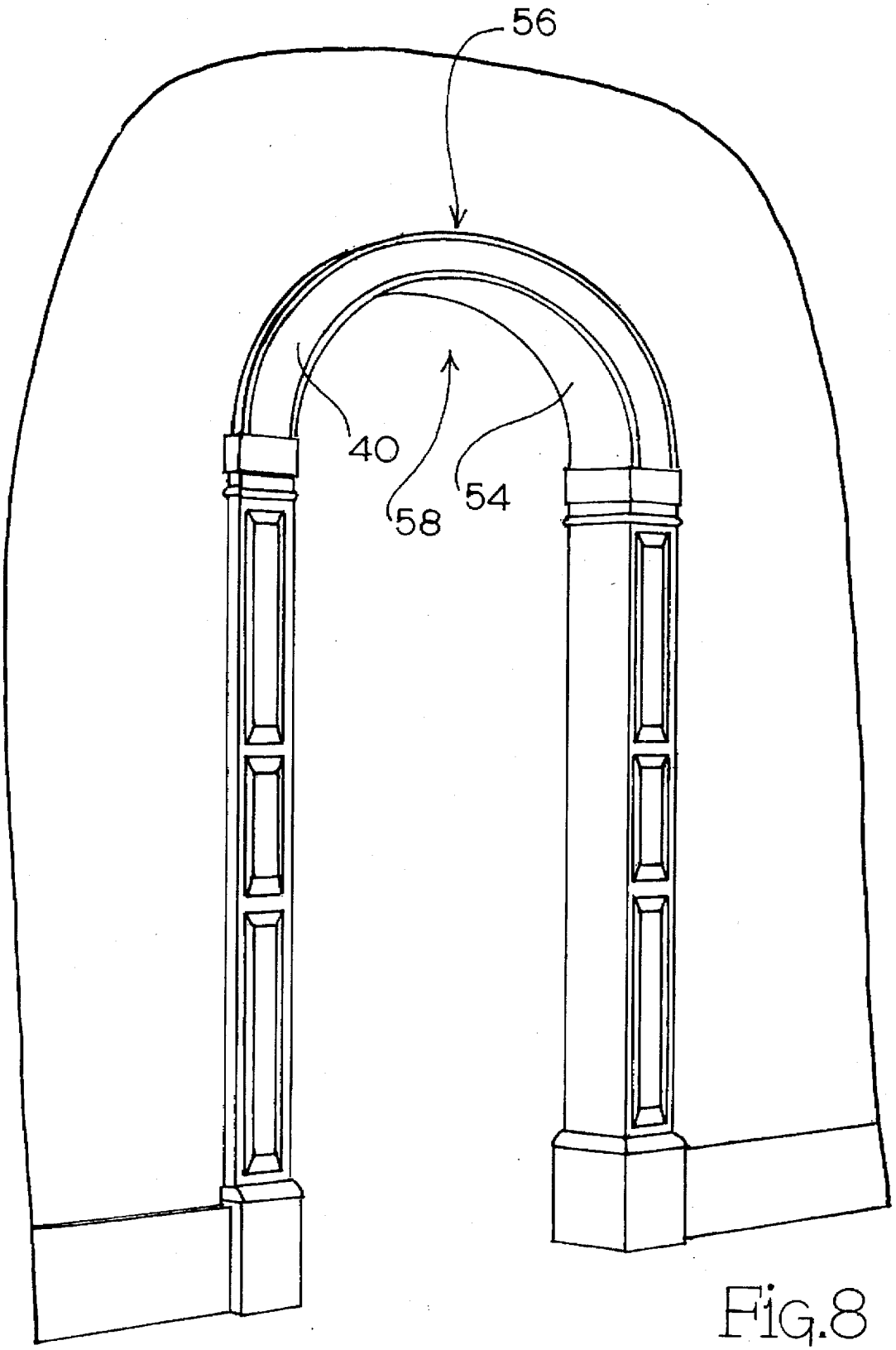
FIG. 8 depicts a door opening having an arched header formed according to the method of the present invention.

As such, in the first method, whereby the flanges 40 become a component of a completed laminated structure 56, the template flanges are preferably made of the same material as the laminates 48, 50. In a typical application, both the flanges 40 and the laminates 48, 50 are made of wood to form a wooden laminated structure 56 such as the door or window frame 58 shown in FIG. 8. In this case, the flanges 40 are preferably permanently engaged with the foundation laminate 48 with a suitable adhesive bond or the like before the structural laminates 50 are bonded onto the facing surfaces of the foundation laminate 48.

In the second method, the flanges could also be made of the same material as the laminates 48, 50, such as wood; however, in this case this is less important because the flanges in this method do not ultimately become part of the completed structure 56. Therefore, in the second method, the flanges 40 could also just as easily be made of metal or some other substance that provides enhanced durability.

Now turning to the steps of the preferred method of the invention, the first step in forming a lamination is to provide at least one template flange 40 of the appropriate shape. Examples of typical template flanges are shown in FIGS. 6A, 6B, and 6C. However, other shapes of curved template flanges could just as easily be used in addition to straight template flanges (not shown). Wood is the preferably material from which the flanges are constructed, especially if the flanges are to ultimately become a component of a structure that includes the lamination formed according to the method, such as the laminated structure 56 shown in FIG. 7. However, other materials such as metal could also be used. In either case, each template flange is preferably a generally planar member with a laminate retainer on an inner surface 44 thereof. As explained above, the laminate retainer preferably comprises a groove 42 cut into a surface of the template flange according to the predetermined shape. However, the laminate retainer could also comprises clamps, fasteners, or other types of structures that are capable of holding an edge the foundation laminate in place.

Next, a strip of foundation laminate 48, such as an elongated strip of wood veneer, is formed into a predetermined shape by hand-bending, for example. The predetermined shape is the shape that the completed lamination 54 will ultimately take on. Unlike previously existing methods of forming curved laminations, the present method does not depend on the use of a specialized mold or other type of form to produce each shape of lamination. The shapes of laminations that can be formed using the method of the present invention are practically limitless. As such, almost any unidirectionally or multidirectionally curved shape can be imparted to a lamination. It is even possible to form circular laminations using the inventive method Next, the shaped foundation laminate 48 is engaged with the laminate retainer of the template flange 40 so that the laminate retainer securely holds the foundation laminate in the predetermined shape. In the preferred embodiment in which the laminate retainer comprises a groove 42 cut into the flange 40, this step involves engaging a side edge of the foundation laminate 48 with the groove 42 by inserting the foundation laminate 48 along its entire length into the groove. The groove 42 is preferably designed to hold the foundation laminate generally perpendicular to the inner surface 44 of the template flange 42, which is itself preferably generally planar.

Although, as noted above, a single template flange 40 may be used in the method of the present invention to hold the foundation laminate 48 in the predetermined shape, the preferred method involves providing a second template flange that is a mirror image of the first to hold the opposite side edge of the foundation laminate 48. This second template flange preferably includes a mirror image laminate retainer, such as a mirror image groove 42, into which is inserted the side edge of the foundation laminate opposite the side edge inserted into the groove in the first template flange. By providing two template flanges 40, the two flanges more securely hold the foundation laminate 48 therebetween in the predetermined shape than would a single flange. As seen in FIG. 7, the two mirror image template flanges 40 are preferably disposed in generally parallel relation to each other and maintain the foundation laminate 48 in generally perpendicular relation thereto. The opposing template flanges 40 and the foundation laminate 48 together form a generally U-shaped trough.

Another aspect to consider when engaging the foundation laminate 48 with the flanges is whether the shaped foundation laminate 48 is to be permanently or releasably engaged with the flanges. If the foundation laminate 48 is permanently engaged with the flanges 40, the template flanges will ultimately become components, along with the lamination 54, of the laminated structure 56 produced according to the method. However, if the foundation laminate 48 is releasably engaged by the template flanges, the template flanges 40 can be reused to form a plurality of identical laminations 54 according to the method of the invention.

Therefore, if the template flanges are to become a part of a completed structure 56 that includes the lamination 54 formed, the foundation laminate 48 is permanently engaged with each template flange by, for example, forming an adhesive bond between the side edges of the foundation laminate and grooves cut into the inner surfaces of the respective template flanges. This basically involves gluing the edges of the foundation laminate 48 into the grooves 42 with, for example, wood glue. An alternate method of permanently engaging the side edges of the foundation laminate 48 with the template flanges 40 is by attaching the foundation laminate to the template flanges with fasteners, clamps, screws, nails, etc.

On the other hand, if the template flanges are to be reused in successive laminating operations to form a plurality of identical laminations 54, the shaped foundation laminate is not permanently but releasably engaged with the laminate retainer of the template flanges. This can be accomplished in several ways that would be apparent to those skilled in the art. Briefly, several such methods of releasable engagement could include frictionally fitting the side edges of the foundation laminate into tight grooves cut into the template flanges or using two-piece template flanges that clamp the foundation laminate in between the pieces thereof.

The next step after engaging the foundation laminate 48 with the template flanges 40, either permanently or releasably, is positioning at least one structural laminate in facing engagement with the foundation laminate 48. In the drawings, three foundation laminates 50*a*, 50*b*, and 50*c* are shown, wherein structural laminate 50*a* is disposed in facing engagement with the face of the foundation laminate 48 that is closest to the bottom edge 46 of each template flange 40, and structural laminates 50*b* and 50*c* are disposed in facing engagement with the opposite face of the foundation laminate 48. As explained earlier, however, any number of structural laminates 50 could be provided. It is possible that only one structural laminate, such as 50*a*, could be provided against a single face of the foundation laminate 48. It is even possible that laminates having varying thicknesses throughout each laminate could be used, or a varying number of laminates throughout the length of a single lamination 54 could be used. In either of these cases, the thickness of the lamination 54 would vary along its length.

As should be understood, the structural laminate or laminates on the same side of the foundation laminate 48 as the template flange bottom edge 46 should at least be even with the flange edges 46 or even protrude therefrom. As can be appreciate from examining the drawings, this is because the capstan 16 will not be able to apply pressure to the laminates 48, 50 if the outermost structural laminate, 50*a* for example, is recessed from the bottom edges 46 of the template flanges 40.

It is also at this time that that a suitable adhesive is applied in between facing surfaces of the foundation laminate 48 and the structural laminates 50. If RF energy is to be used to heat-cure the adhesive, then a heat-curable glue is used. Otherwise, some other appropriate fast-curing adhesive is used. When cured, the glue will form glue joints 52 between the laminates, which can be seen best in FIG. 7.

The last basic steps in forming a lamination 54 according to the method of the invention are pressing the laminates 48, 50 together while holding the foundation laminate 48 in the predetermined shape and curing the adhesive. By doing so, the structural laminates 50 conform to the shape of the foundation laminate 48. Thus, when the adhesive sets, the individual laminates form a lamination 54 that assumes the predetermined shape of the foundation laminate 48. Preferably, the adhesive is set by transmitting RF energy through the laminates and the heat-curable glue used as the adhesive, while the laminates are being pressed together. In addition, this pressing and adhesive setting is preferably carried out using an embodiment of the laminating machine of the invention although the inventive method does not necessarily depend on the use of the inventive machine.

To use the machine of the invention to carry out the pressing (and glue curing) step to form a finished lamination 54, the assembled template flanges 40, foundation laminate 48, and structural laminates are fed into the lamination passage 38 of a suitable embodiment of the laminating machine of the invention. It should be appreciated that different embodiments of the laminating machine are more suitable for certain shapes of laminations than are others. For example, laminations with reverse-curves are best formed using the embodiment of the laminating machine 10 shown in FIGS. 1–2. At the beginning of the lamination process using the machine of the invention, the laminates 48, 50 may be temporarily clamped together to hold them in position until they are fed through the lamination passage 38 and laminated together.

When using the machine of the present invention to carry out the inventive method, the first step is to insert one end of the template flange/laminate assembly in between the capstan 16 and the anvil 17 of one of the embodiments of the laminating machine. The anvil 17 preferably does not contact the template flanges 40 at all, at least not enough to exert any significant force thereon, but instead is disposed between the template flanges 40, where it contacts the opposite side of the laminates as the capstan.

After the laminates have been inserted into the lamination passage 38 between the capstan and the anvil, the clamping mechanism moves the capstan and the anvil towards each other to thereby narrow the lamination passage 38 and clamp the laminates together. The type of clamping mechanism employed depends on the particular embodiment of the laminating machine being used; however, the purpose is the same for all embodiments: to clamp the laminates 48, 50 together.

Next, the drive motor 20 is actuated to rotate the capstan 16, and the laminates 48, 50 are moved through the lamination passage 38 between the rotating capstan 16 and the opposing anvil 17, all the while being pressed together. At the same time, the RF energy source 14 is actuated, transmitting RF energy from the capstan 16 through the laminates 48, 50 to the anvil 17 and thereby heat-curing the adhesive to form glue joints 52. The length of time that any individual point on the outer surface of the laminates 50*a* and 50*c* is under pressure in the lamination passage 38 depends somewhat on the size and shape of the capstan 16 and anvil 17. The larger the radius of the capstan and/or anvil, the larger the contact footprint and therefore the longer the time the laminates are under pressure. Therein lies the reason that the capstan sleeve 32 and anvil plate 36 are advantageous. In addition, the embodiment of the machine 80 wherein the anvil 17 comprises an endless band 90 delivers pressure to the laminates for the longest time of any of the embodiments. As can be seen from an examination of FIG. 5, it can be appreciated that laminates passing through the lamination passage 38 in laminating machine 80 will encounter pressure for an especially long period of time because of the large surface area 98 formed by the contact of the endless band 90 with the laminates.

Therefore, an optional step that may be followed using any embodiment of the laminating machine of the present invention to carry out the inventive method includes disposing the capstan sleeve 32 around the capstan 16 to thereby increase the surface contact area 34 between the capstan 16 and the laminates. Another optional step that may be followed, particularly when using the embodiment of the laminating machine 10 shown in FIGS. 1–2, is disposing the elongated anvil plate 36 between the capstan 16 and the roller wheel 22 to thereby increase the effective width of the roller wheel 22. Thus, even pressure is applied to laminates 48, 50 having greater widths than the roller wheel 22. If laminates of varying thickness are used or if a varying number of structural laminates are used throughout a single lamination, the width of the lamination passage 38 may be varied accordingly to accommodate the varying thickness of the lamination being formed therein. This can be accomplished by providing for some resiliency in the clamping mechanism, such as would occur with the fluid cylinders 28 preferably used in the first-described embodiment 10 of the laminating machine.

After the lamination 54 has been formed using the method of the present invention, the lamination can be incorporated into a completed structure such as a doorway or window arched header 56. FIG. 7 shows a cross-section of a typical completed laminated structure 56, which includes both a bottom lamination 54 formed according to the present invention and two parallel side walls formed by the template flanges 40. This structure is shown being formed of wood and having three structural laminates 50*a,b,c* and a single foundation laminate 48. Here, the foundation laminate 48 is wider than the structural laminates such that the side edge of the foundation laminate extends beyond the side edges of the structural laminates and into the groove 42. As such, the foundation laminate is preferably the only laminate engaged by the groove 42. Preferably, the foundation laminate 48 is held in the groove 42 by an adhesive bond. One structural laminate 50*a* is shown below the foundation laminate 48, whereas two structural laminates 50*b,c* are shown above the foundation laminate 48. A completed structure 56 such as this could be used to form part of an entire doorway or window opening frame 58, such as the one depicted in FIG. 8.

If the foundation laminate 48 was initially permanently engaged with the lamination retainer or grooves 42 in the template flanges 40, then the template flanges 40 will form part of the completed laminated structure 56. If, on the other hand, the foundation laminate 48 was releasably engaged with the laminate retainers of the template flanges 40, then the last step that takes place in the method of the invention is disengaging the template flanges 40 from the lamination 54 formed. The template flanges 40 can then be reused to form a plurality of laminations 54 having the predetermined shape but without the template flanges 40 remaining attached.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of forming laminations made of a plurality of individual laminates bonded together by an adhesive, including the steps of:

a) providing a template flange that includes a laminate retainer;

b) shaping a foundation laminate into a predetermined shape;

c) engaging the shaped foundation laminate with the laminate retainer of the template flange so that the laminate retainer holds the foundation laminate in the predetermined shape;

d) positioning at least one structural laminate in generally facing engagement with the foundation laminate held by the laminate retainer;

e) applying adhesive in between facing surfaces of the foundation laminate and the at least one structural laminate; and f) pressing the laminates together while holding the foundation laminate in the predetermined shape, thereby forming a lamination that assumes the predetermined shape of the foundation laminate.

2. The method according to claim 1, including the step of cutting a groove into a surface of the template flange according to the predetermined shape, whereby the groove forms the laminate retainer.

3. The method according to claim 1, wherein the step of shaping the foundation laminate includes shaping the foundation laminate into a unidirectional curve.

4. The method according to claim 1, wherein the step of shaping the foundation laminate includes shaping the foundation laminate into a multidirectional curve.

5. The method according to claim 1, wherein the step of shaping the foundation laminate includes shaping the foundation laminate into a closed loop.

6. The method according to claim 1, wherein the step of engaging the shaped foundation laminate with the laminate retainer includes engaging a side edge of the foundation laminate with the laminate retainer and holding the foundation laminate generally perpendicularly to the template flange.

7. The method according to claim 1, including the step of permanently engaging a side edge of the foundation laminate with the laminate retainer, whereby the template flange becomes a component of a laminated structure that includes the lamination formed according to the method.

8. The method according to claim 7, including the step of permanently engaging the side edge of the foundation laminate with the laminate retainer by forming an adhesive bond between the side edge of the foundation laminate and a groove cut into an inner surface of the template flange.

9. The method according to claim 7, including the step of permanently engaging the side edge of the foundation laminate with the laminate retainer by attaching the foundation laminate to the template flange with at least one fastener.

10. The method according to claim 1, wherein the step of engaging the shaped foundation laminate with the laminate retainer includes releasably engaging a side edge of the foundation laminate with the laminate retainer.

11. The method according to claim 10, further including the step of disengaging the template flange from the laminated structure formed.

12. The method according to claim 11, further including the step of reusing the template flange to form a plurality of laminations having the predetermined shape.

13. The method according to claim 1, including the step of positioning at least one structural laminate on each side of the foundation laminate in generally facing engagement with the foundation laminate.

14. The method according to claim 1, including the step of applying heat-curable glue in between facing surfaces of the foundation laminate and the at least one structural laminate.

15. The method according to claim 14, including the step of transmitting RF energy through the laminates to heat-cure the glue.

16. The method according to claim 1, wherein the step of pressing the laminates together includes moving the laminates through a lamination passage between a rotating capstan and an opposing anvil.

17. The method according to claim 16, including the step of disposing a sleeve around the capstan, the sleeve having a greater radius than the capstan to thereby increase a surface contact area between the capstan and the laminates.

18. The method according to claim 16, including the step of moving the capstan and the anvil towards each other to thereby narrow the lamination passage and clamp the laminates together.

19. The method according to claim 16, including the step of disposing an elongated plate between the capstan and the anvil, the elongated plate having a greater width than the anvil, thereby effectively widening the anvil so that even pressure is applied to laminates having greater widths than the anvil.

20. The method according to claim 16, including the step of moving at least one of the capstan and the anvil in the longitudinal direction of the other to thereby move the laminate between the capstan and the anvil.

21. The method according to claim 16, including the step of transmitting RF energy from the capstan through the laminates to the anvil, thereby heat-curing the adhesive.

22. The method according to claim 16, including the step of varying the width of the lamination passage to accommodate varying thicknesses of laminates.

23. The method according to claim 1, including the steps of providing a second template flange having a mirror image laminate retainer and engaging the shaped foundation laminate with the mirror image laminate retainer of the second template flange so that the two template flanges hold the foundation laminate therebetween in the predetermined curved shape.

24. The method according to claim 23, including the steps of maintaining the two template flanges in generally parallel relation to each other and maintaining the foundation laminate in generally perpendicular relation to both template flanges.

25. A method of forming curved laminations made of a plurality of individual laminates bonded together by an adhesive, including the steps of:

a) providing a template flange;

b) cutting a groove according to a predetermined curved shape into a surface of the template flange;

c) shaping a foundation laminate into the predetermined curved shape;

d) engaging an edge of the shaped foundation laminate with the curved groove in the template flange so that the groove holds the foundation laminate in the predetermined curved shape;

e) positioning at least one structural laminate in generally facing engagement with the foundation laminate held in the groove;

f) applying glue in between facing surfaces of the foundation laminate and the at least one structural laminate;

g) while holding the foundation laminate in the predetermined curved shape, pressing the laminates together by moving the laminates through a lamination passage between a rotating capstan and an opposing anvil; and h) while moving the laminates through the lamination passage, transmitting RF energy through the laminates, thereby heat-curing the glue and forming a curved lamination that assumes the predetermined shape of the foundation laminate.

26. The method according to claim 25, wherein the step of shaping the foundation laminate includes shaping the foundation laminate into a unidirectional curve.

27. The method according to claim 25, wherein the step of shaping the foundation laminate includes shaping the foundation laminate into a multidirectional curve.

28. The method according to claim 25, including the step of permanently engaging the edge of the foundation laminate with the groove by forming an adhesive bond between the edge of the foundation laminate and the groove, whereby the template flange becomes a component of a laminated structure that includes the curved lamination formed according to the method.

29. The method according to claim 25, further including the steps of disengaging the template flange from the curved lamination and reusing the template flange to form a plurality of curved laminations having the predetermined shape.

30. The method according to claim 25, including the step of engaging an opposite edge of the shaped foundation laminate with a curved groove in a second template flange so that the two template flanges hold the foundation laminate therebetween in the predetermined curved shape.

* * * * *